US006435220B1

(12) United States Patent
Smith et al.

(10) Patent No.: US 6,435,220 B1
(45) Date of Patent: Aug. 20, 2002

(54) CARPET BACKING AND METHODS OF MAKING AND USING THE SAME

(75) Inventors: Kirk D. Smith, Fisherville, VA (US); Brent Sizemore, Calhoun, GA (US)

(73) Assignees: Wayn-Tex, Inc, Waynesboro, VA (US); Mohawk Carpet Corp., Calhoun, GA (US)

( * ) Notice: Subject to any disclaimer, the term of this patent is extended or adjusted under 35 U.S.C. 154(b) by 0 days.

(21) Appl. No.: 09/348,760

(22) Filed: Jul. 7, 1999

(51) Int. Cl.[7] ..... D03D 23/00

(52) U.S. Cl. ..... 139/383 R; 139/420 R; 139/420 A; 139/426 R

(58) Field of Search ..... 139/383 R, 426 R, 139/420 R, 420 A

(56) References Cited

U.S. PATENT DOCUMENTS

| | | | | |
|---|---|---|---|---|
| 3,110,905 A | | 11/1963 | Rhodes | 139/391 |
| 3,285,797 A | | 11/1966 | Harrison et al. | 161/67 |
| 3,317,366 A | | 5/1967 | Dionne | 161/66 |
| 3,325,323 A | | 6/1967 | Forkner | 156/72 |
| 3,443,541 A | | 5/1969 | Chopra | 112/410 |
| 3,535,192 A | | 10/1970 | Gamble | 161/66 |
| 3,542,632 A | | 11/1970 | Eickhoff | 161/65 |
| 3,607,599 A | | 9/1971 | McPherson | 161/144 |
| 3,642,516 A | | 2/1972 | Gasaway et al. | 117/65.2 |
| 4,096,302 A | | 6/1978 | Thibodeau et al. | 428/95 |
| 4,112,161 A | | 9/1978 | Sorrells | 428/95 |
| 4,342,802 A | | 8/1982 | Pickens, Jr. et al. | 428/92 |
| 4,389,443 A | | 6/1983 | Thomas et al. | 428/92 |
| 4,439,476 A | | 3/1984 | Guild | 428/96 |
| 4,478,900 A | | 10/1984 | Nebe et al. | 428/92 |
| 4,556,602 A | | 12/1985 | Williams | 428/259 |
| 4,660,605 A | * | 4/1987 | Koch | 139/420 R |
| 4,871,603 A | | 10/1989 | Malone | 428/95 |
| 4,872,930 A | | 10/1989 | Kajikawa et al. | 156/72 |
| 4,906,520 A | | 3/1990 | Kumar | 428/225 |
| 4,981,161 A | * | 1/1991 | Pickering et al. | 139/383 R |
| 5,014,755 A | * | 5/1991 | Bompard et al. | 139/420 A |
| 5,030,497 A | | 7/1991 | Claessen | 428/95 |
| 5,034,258 A | | 7/1991 | Grace | 428/78 |
| 5,198,277 A | | 3/1993 | Hamilton et al. | 428/92 |
| 5,216,790 A | | 6/1993 | Eschenbach | 28/112 |
| 5,244,718 A | | 9/1993 | Taylor et al. | 428/229 |
| 5,348,785 A | | 9/1994 | Vinod | 428/95 |
| 5,464,677 A | | 11/1995 | Corbin et al. | 428/95 |
| 5,484,639 A | | 1/1996 | Woodall et al. | 428/95 |
| 5,520,962 A | | 5/1996 | Jones, Jr. | 427/393.4 |
| 5,558,916 A | | 9/1996 | Heim et al. | 428/95 |
| 5,604,009 A | | 2/1997 | Long et al. | 428/95 |
| 5,612,113 A | | 3/1997 | Irwin, Sr. | 428/95 |
| 5,630,896 A | | 5/1997 | Corbin et al. | 156/72 |
| 5,654,066 A | | 8/1997 | Pacione | 428/95 |
| 5,714,224 A | | 2/1998 | Gerry | 428/95 |
| 5,756,152 A | | 5/1998 | Lin et al. | 427/207.1 |
| 5,763,040 A | | 6/1998 | Murphy et al. | 428/96 |
| 5,769,130 A | * | 6/1998 | Brielmann | 139/22 |
| 5,800,898 A | | 9/1998 | Gerry | 428/95 |
| 5,834,087 A | | 11/1998 | Kajikawa et al. | 428/95 |
| 5,866,229 A | | 2/1999 | Gartner et al. | 428/114 |
| 6,199,597 B1 | * | 3/2001 | David | 139/383 R |

FOREIGN PATENT DOCUMENTS

| | | |
|---|---|---|
| WO | 09807 | 12/1998 |

* cited by examiner

*Primary Examiner*—John J. Calvert
*Assistant Examiner*—Robert H. Muromoto, Jr.
(74) *Attorney, Agent, or Firm*—Hunton & Williams

(57) ABSTRACT

A woven carpet backing may include monofilament warp yarns and alternating monofilament and multifilament fill yarns. The yarns may be woven using a weave, such as a non-traditional weave, that places all of the multifilament fill yarns on the face of the fabric and all of the monofilament fill yarns on the back of the fabric. Monofilament fill yarns and multifilament fill yarns are overstuffed, thereby creating a coverage factor greater than one hundred percent. The invention results in a carpet backing with the appearance of a primary carpet backing on one side of the fabric and the appearance of a secondary carpet backing on the opposite side of the fabric. The need for a secondary carpet backing is eliminated by the woven carpet backing.

36 Claims, 6 Drawing Sheets

CARPET BACKING AND METHODS OF MAKING AND USING THE SAME

FIELD OF THE INVENTION

The present invention involves woven carpet backings and a method of manufacturing and using such backings.

BACKGROUND OF THE INVENTION

Conventional carpets are generally constructed by inserting a piling yarn through a primary backing fabric (also referred to herein as "primary carpet backing" or "primary backing") to form tufts of yarn which project from the surface of the fabric. The piling yarn may be inserted through the use of a tufting needle, which penetrates the primary carpet backing. The primary backing is then coated with an adhesive to secure the yarn to the primary backing, and to allow a secondary carpet backing (or "secondary backing") to be affixed to the primary backing. A primary backing may be made of a woven fabric, or may be made of a non-woven fabric.

One type of conventional primary carpet backing may comprise a woven fabric, made of warp yarns and fill yarns using a traditional weave, such as a plain weave. The term "fill yarn" may also be known as a "weft yarn" or "woof yarn." Woven carpet backings are easier to process through tufting than non-woven carpet backings, and have the ability to "heal" from tufting penetrations. The term "heal" refers to the hole caused by a tufting needle closing once the needle is removed from the backing.

Another conventional primary carpet backing comprises a non-woven fabric. A non-woven fabric is usually defined as an assembly of textile fibers joined by mechanical interlocking in a random web or mat. Fibers may also be joined by fusing (in the case of thermoplastic fibers) or by bonding with a cementing medium, such as starch, glue, casein, rubber, latex, a cellulose derivative, or a synthetic resin. Non-woven fabrics generally have greater dimensional stability than woven fabrics.

Conventional carpet may suffer from a drawback, e.g., requiring both a primary carpet backing and a secondary carpet backing. This construction requires two backings to manufacture the carpet, thereby increasing materials, costs, and time for constructing a carpet.

SUMMARY OF THE INVENTION

An object of the invention is to overcome this and other drawbacks in existing carpets.

Another object of the invention is to provide a woven carpet backing ("carpet backing" or "backing") comprising monofilament warp yarns and alternating monofilament and multifilament fill yarns.

Another object of the invention is to provide a woven carpet backing with the look of a primary carpet backing on one side of the woven carpet backing and the look of a secondary carpet backing on the other side of the woven carpet backing.

Another object of the invention is to provide a carpet with similar dimensional stability to conventional carpeting without requiring the use of a secondary carpet backing.

Another object of the invention is to provide a woven carpet backing where substantially all of the multifilament fill yarns are placed on one side of the woven carpet backing and substantially all of the monofilament fill yarns are placed on the other side of the carpet backing.

Another object of the invention is to provide a woven carpet backing where the fill yarn coverage factor is large enough to cause adjacent fill yarns to physically contact at least a portion of each other.

Another object of the invention is to provide a carpet using the woven carpet backing of the present invention.

These and other objects of the invention are accomplished according to various embodiments of the invention. One embodiment of the invention provides a woven carpet backing. The woven carpet backing comprises monofilament warp yarns and alternating multifilament and monofilament fill yarns. The woven carpet backing is woven using a weave, preferably a non-traditional weave, that places substantially all of the multifilament fill yarns on one side of the carpet backing and substantially all of the monofilament fill yarns on the other side of the carpet backing. In one embodiment, substantially all of the multifilament fill yarns are placed on the face of the carpet backing and substantially all of the monofilament fill yarns are placed on the back of the carpet backing. The carpet backing may be overstuffed such that the monofilament fill yarn coverage factor, and/or the fill yarn coverage factor are greater than one hundred percent.

Another embodiment of the invention provides a method of using a floor covering comprising tufted pile yarns inserted into a woven carpet backing. The method comprises forming a woven carpet backing comprising monofilament warp yarns and alternating monofilament and multifilament fill yarns. The woven carpet backing includes substantially all of the monofilament fill yarns on one side of the woven carpet backing and substantially all of the multifilament fill yarns on the other side of the woven carpet backing. Subsequently, carpet yarns are tufted through the carpet backing to form the floor covering, which is placed on an area of the floor. Preferably, an adhesive agent, such as a conventional latex mixture or cementing medium, such as starch, glue, casein, rubber, latex, a cellulose derivative, or a synthetic resin, or any adhesive conventionally used in floor coverings is then applied to the face of the carpet backing. The adhesive agent is believed to improve carpet stability and improve tuft bind, i.e., locks in carpet yarns. The woven carpet backing may be overstuffed such that the monofilament fill yarn coverage factor, and/or the fill yarn coverage factor are greater than one hundred percent.

Thus, the floor covering comprises a single carpet backing having carpet yarns tufted into it. This eliminates the need for a primary carpet backing and a secondary carpet backing considered necessary in conventional carpets.

Another embodiment of the invention provides a process for making a woven carpet backing comprising weaving a woven carpet backing comprising monofilament warp yarns and monofilament and multifilament fill yarns. The woven carpet backing includes substantially all of the monofilament fill yarns on one side of the woven carpet backing and substantially all of the multifilament fill yarns on the other side of the woven carpet backing. The woven carpet backing may be overstuffed such that the monofilament fill yarn coverage factor, and/or the fill yarn coverage factor are greater than one hundred percent.

Yet another embodiment of the invention is directed to a floor covering, such as a carpet, which includes:

(i) a woven carpet backing including warp and fill yarns, wherein the warp yarns comprise monofilament yarns and the fill yarns comprise alternating monofilament and multifilament yarns;

(ii) carpet fibers tufted into the woven carpet backing so that a top portion of the fibers protrudes from a back of the woven carpet backing and, preferably (iii) a layer of an adhesive agent on a face of the woven carpet backing.

The woven carpet backing of the floor covering may be woven such that substantially all of the monofilament fill yarns are placed on one side of the woven carpet backing and substantially all of the multifilaments fill yarns are placed on the other side of the woven carpet backing. The woven carpet backing may be overstuffed such that the monofilament fill yarn coverage factor, and/or the fill yarn coverage factor are greater than one hundred percent.

Still another embodiment of the invention provides a woven carpet backing comprising a warp and a fill including two yarn types. Either the warp or the fill includes the two yarn types in an alternating fashion. The other of the warp and the fill uses only one of the two yarn types. The woven carpet backing is woven so that substantially all of one of the two alternating yarn types are located on the face of the woven carpet backing, and substantially all of the other of the two alternating yarn types are located on the back of the woven carpet backing. The woven carpet backing may be used in connection with a carpet, where carpet yarns are tufted through the woven carpet backing, and an adhesive agent is applied to the front of the woven carpet backing to secure the carpet yarns. A carpet comprising the woven carpet backing of this embodiment may further be used as a floor covering.

These and other objects of the present invention shall become apparent from the accompanying drawings and detailed description of the invention which follows.

DETAILED DESCRIPTION OF THE PREFERRED EMBODIMENTS

The woven carpet backing of the present invention may be used as the only backing in a carpet or floor covering. Nonetheless, the woven carpet backing of this invention can be used with other floor covering components, e.g., with conventional secondary or primary carpet backings.

The woven carpet backing of the invention is used to provide a finished floor covering (e.g., a carpet) with similar dimensional stability compared with a conventional carpet which uses a primary backing and a secondary backing. To make a finished floor covering, the woven carpet backing is tufted with pile yarns in a conventional manner to form a tufted carpet, and an adhesive agent, such as a latex mixture, cementing medium, such as starch, glue, casein, rubber, latex, a cellulose derivative or a synthetic resin, or an adhesive, such as any adhesive conventionally used in floor coverings, is applied to the front of the woven carpet backing having the tufted pile yarns. No separate secondary backing is required. Nonetheless, a secondary backing may be attached to the front of the woven carpet backing having the adhesive agent applied to it.

Figure 1:
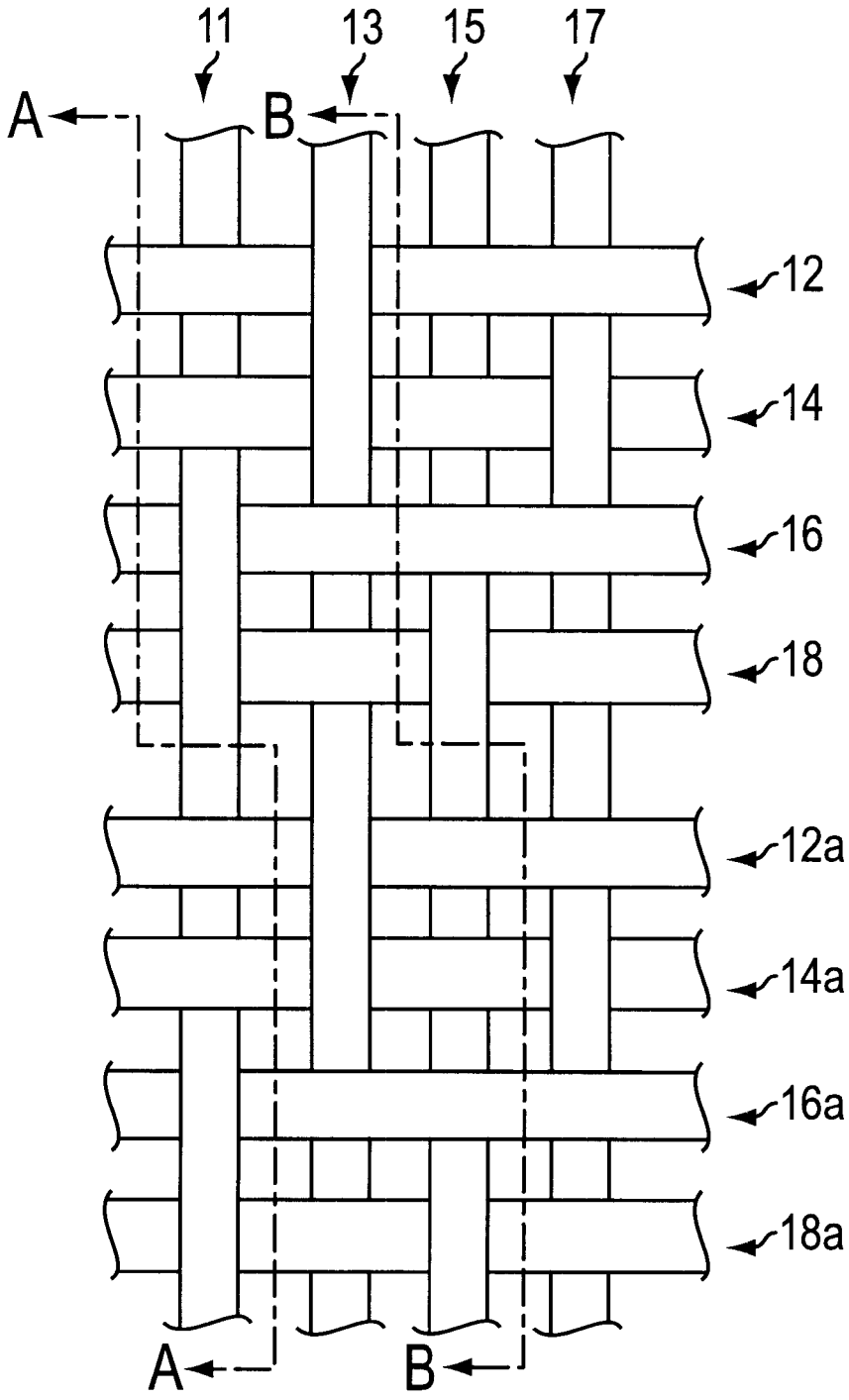
FIG. 1 is an illustration of a non-traditional weave according to an embodiment of the invention.

According to an embodiment of the invention, the woven carpet backing may be woven using any weave, preferably a non-traditional weave, to provide the carpet backing of this invention. FIG. 1 illustrates a non-traditional weave pattern according to an embodiment of the invention. The weave pattern is repeated throughout the woven carpet backing. In the embodiment of FIG. 1, two repetitions of the weave pattern are illustrated. A woven carpet backing (10) comprises monofilament warp yarns (11, 13, 15, 17), and alternating multifilament fill yarns (12, 16, 12*a*, 16*a*) and monofilament fill yarns (14, 18, 14*a*, 18*a*).

According to an embodiment of the invention, multifilament fill yarns (12, 16) may comprise open end spun yarn or a continuous filament yarn and monofilament fill yarns (14, 18, 14*a*, 18*a*) and monofilament warp yarns (11, 13, 15, 17) may comprise tape yarn.

Figure 2:
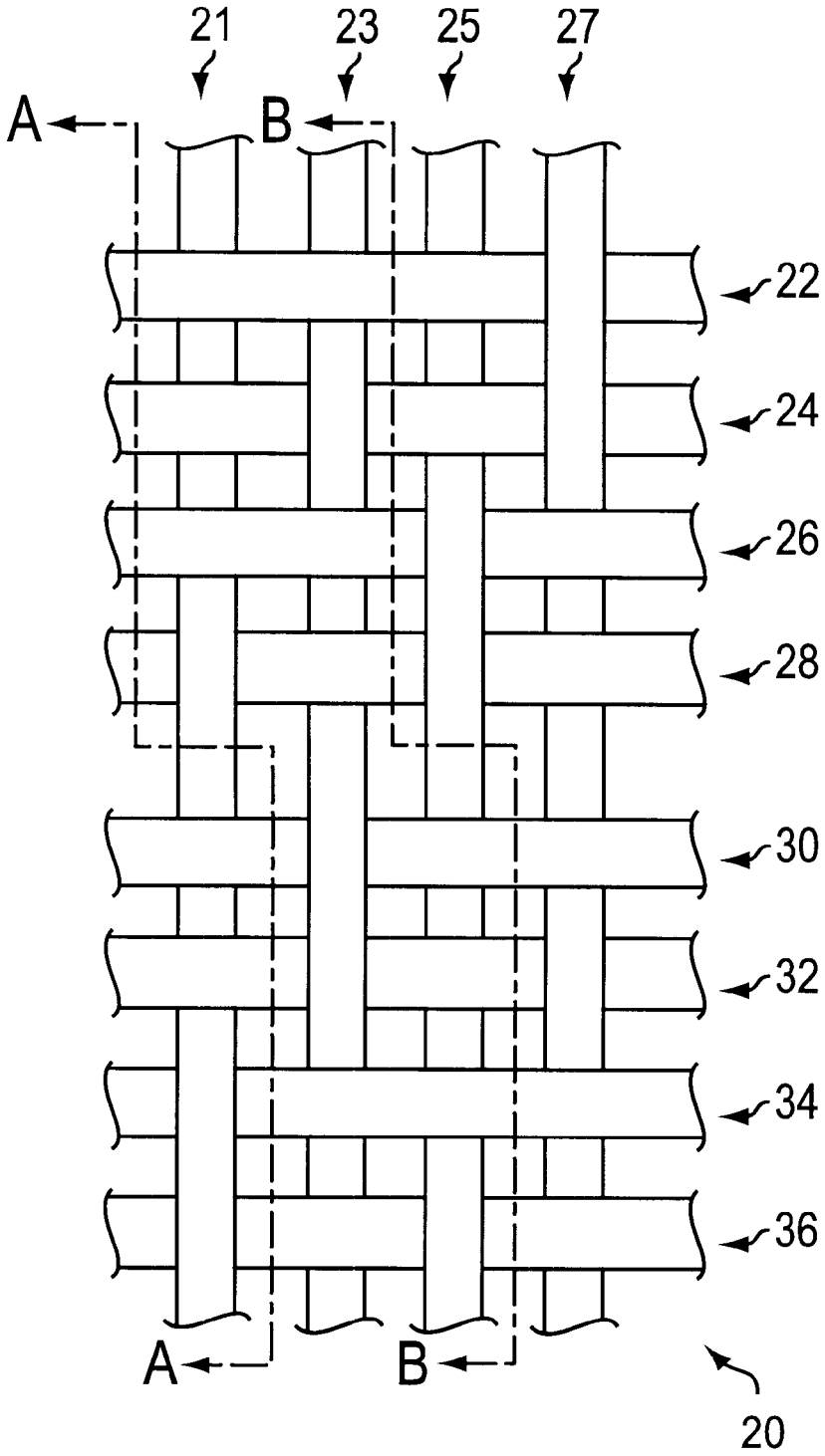
FIG. 2 is an illustration of a non-traditional weave according to another embodiment of the invention.

FIG. 2 illustrates a non-traditional weave pattern according to another embodiment of the invention. As with the weave of FIG. 1 above, the weave pattern may be repeated throughout the woven carpet backing. A woven carpet backing 20 comprises monofilament warp yarns (21, 23, 25, 27), and alternating multifilament fill yarns (22, 26, 30, 34) and monofilament fill yarns (24, 28, 32, 36). According to an embodiment of the invention, multifilament fill yarns (22, 26, 30, 34) may comprise open end spun yarn or continuous filament yarn and monofilament fill yarns (24, 28, 32, 36) and monofilament warp yarns (21, 23, 25, 27) may comprise tape yarn.

According to one broader embodiment of the invention, a woven carpet backing including a warp and a fill may include two yarn types. Either the warp or the fill may include the two yarn types in an alternating fashion. The other of the warp and the fill uses only one of the two yarn types. The woven carpet backing is woven so that substantially all of one of the two alternating yarn types is located on the face of the woven carpet backing, and substantially all of the other of the two alternating yarn types is located on the back of the woven carpet backing. FIGS. 1 and 2 illustrate two examples of such an embodiment, where the two alternating yarn types are multifilament yarns and monofilament yarns. In the embodiments of FIGS. 1 and 2, the warp yarn comprises monofilament yarn, and the fill yarn comprises alternating multifilament yarns and monofilament yarns. All of the parameters of other embodiments of the invention, e.g., those of FIGS. 1 and 2, such as the number of ends and picks per inch, the denier of the yarn, the coverage factor for the monofilament fill yarns, the coverage factor for the monofilament and multifilament fill yarns, and the various dimensions of the yarns also apply to this broader embodiment of the invention. Thus, in this embodiment, that component of the weave (i.e., the warp or the fill) which includes the two alternating yarn types will be overstuffed. The total coverage factor for that component (for both of the alternating yarn types) may be about ninety percent (90%) to about three hundred percent (300%), preferably about one hundred (100%) to about two hundred percent (200%), and more preferably about one hundred fifty percent (150%). Other ranges of coverage factor may also be used. Other embodiments and variations of the weave and types of yarns may also be used. Also, the carpet backing of this broader embodiment of the invention can be used to make a floor covering (such as a carpet). The floor covering is made in substantially the same manner as with the carpet backing of other embodiments of the invention, discussed herein.

In any embodiment of the invention, these yarns are woven using any weave which produces the carpet backing of the invention, preferably a non-traditional weave with a typical construction of about 10 to about 40 ends (i.e. yarns) per inch, preferably about 20 to about 30 ends per inch, more preferably about 22 to about 26 ends per inch, and most preferably about 24 ends per inch (warp yarns), and about 10 to about 50 picks (i.e. yarns) per inch, preferably about 20 to about 40 picks per inch, more preferably about 21 to about 30 picks per inch and most preferably about 22 picks per inch (fill yarns). In one embodiment of the invention, warp yarns of the woven carpet backing may range in size from about 100 to about 900 denier, preferably about 250 to about 750 denier, more preferably about 350 denier to about 600 denier, and still more preferably about 475 denier. Fill yarns may range in size from about 250 to about 2000 denier, preferably about 500 to about 1500 denier, more preferably about 750 denier to about 1250 denier, and still more preferably about 1050 denier for monofilament yarns and about 250 to about 3000 denier, preferably about 500 to about 2500 denier, more preferably about 1000 denier to about 2000 denier, and still more preferably about 1700 denier for multifilament yarns.

The monofilament and multifilament yarns may be made of synthetic fibers, such as polypropylene, nylon, polyester, or polyethylene. In one embodiment, the monofilament warp yarns are made of polypropylene, and monofilament fill yarns are made of polypropylene. The monofilament warp yams may be made of the same or different material than the monofilament fill yarns. According to an embodiment of the invention, multifilament yarns may be spun yarn, ring spun yarn, open end spun yam, continuous filament yarn or other types of multifilament yarn. The monofilament yarns may be single, untwisted filaments, tape yarn, or other types of monofilament yarn. The monofilament warp yarns may have the same or a different structure than the monofilament fill yarns.

According to a preferred embodiment of the invention, the woven carpet backing comprises a warp and a fill. The warp consists of monofilament tape yarns and the fill consists of alternating monofilament tape yarns and multifilament open end spun fibers. The woven carpet backing is woven with a construction consisting of about 22 picks per inch, and about 24 ends per inch.

Figure 3A:
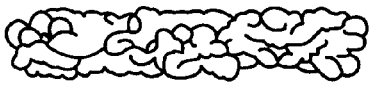
FIGS. 3*a*–3*f* illustrate examples bulk continuous fiber which may be used in an embodiment of the invention.
Figure 3B:
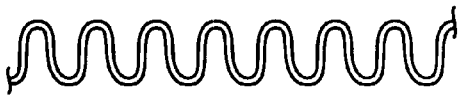
Figure 3C:
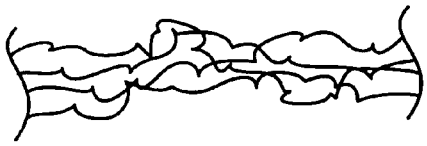
Figure 3D:
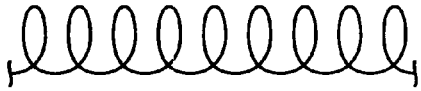
Figure 3E:
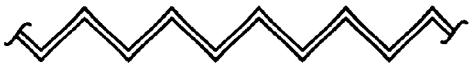
Figure 3F:
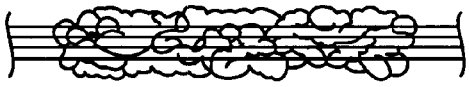

According to an embodiment of the invention, multifilament yarns may be bulk continuous filaments, wherein the filaments have a body. FIGS. 3*a*–3*f* illustrate various bulk continuous filaments which may be used for the multifilament fill yarns. FIG. 3*a* illustrates an entangled yam. Entangled yarn develops bulk by leading the yarn through the turbulent region of an air jet faster than the rate at which the yarn is drawn away from the air jet. FIG. 3*b* illustrates a knit-de-knit crinkled yarn. A crinkle yarn is characterized by a periodic wave configuration. The knit-de-knit method involves knitting the yarn into a hoseleg, heat-setting the yarn in an autoclave, and unraveling and winding the yarn onto a package. FIG. 3*c* illustrates a multifilament coil yarn, where the yarn has a coil or spiral configuration. FIG. 3*d* illustrates a monofilament coil yarn. FIG. 3*e* illustrates a stuffer box crinkle yarn made by compressing the yarn into a heated stuffer box, causing the individual filaments to fold or bend at a sharp angle while being simultaneously set by a heating device. FIG. 3*f* illustrates core-bulked yarn, which comprises two sets of filaments. One set is straight to give dimensional stability and forms a core around and through which the other set is coiled or looped to provide bulk. Without being held to a particular manner of operability, it is believed that the use of multifilament yarns provides increased surface area, thereby allowing an adhesive agent, such as a latex mixture, to more easily adhere to the woven carpet backing.

The woven carpet backing of the present invention has the appearance of a primary carpet backing on the face of the woven carpet backing, and the appearance of a secondary carpet backing on the back of the woven carpet backing. The face of the woven carpet backing may be defined as the side of the woven carpet backing which, as the woven carpet backing is woven on a loom, faces upward. The face of the woven carpet backing is the side of the woven carpet backing which, once finished into a floor covering, such as a carpet, will be in contact with the floor. The back of the woven carpet backing may be defined as the side of the woven carpet backing which, as the woven carpet backing is woven on a loom, faces downward. The back of the woven carpet backing is the side of the woven carpet backing which, once finished into a floor covering, such as a carpet, will form the walking surface. According to an embodiment of the invention, the appearance of a primary backing on the back of the woven carpet backing and the appearance of a secondary backing on the face of the woven carpet backing may be achieved by placing substantially all of multifilament fill yarns on the face of the woven carpet backing, and substantially all of the monofilament fill yarns on the back of the woven carpet backing.

The term "substantially all of multifilament fill yarns on the face of the woven carpet backing" means that at the interlaces, at least fifty percent (50%) of all multifilament fill yarns are placed on the face of the woven backing. Interlaces refer to the intersections of the warp yarns and the fill yarns. Thus, if at the interlaces at least fifty percent (50%) of multifilament fill yarns are placed on the face of the woven backing (or fabric), then at least fifty percent (50%) of the multifilament fill yarns are located above a warp yarn at the interlaces of the face of the woven carpet backing. According to an embodiment of the invention, the woven carpet backing may be woven such that at the interlaces about fifty percent (50%) to about eighty-three percent (83.3%) of multifilament fill yarns are placed on the face of the woven carpet backing. By way of example, the non-traditional weaves illustrated in FIGS. 1 and 2 create at the interlaces about seventy-five percent (75%) of multifilament fill yarns on the face of the woven carpet backing. The face of the woven carpet backing may comprise higher percentages of multifilament fill yarns at the interlaces. The upper limit of the percentage of multifilament fill yarns at the interlaces on the face of the woven carpet backing is only limited by the limitations of machines used to weave the woven carpet backing. Other types of non-traditional weaves or traditional weaves, which produce the woven carpet backing of the invention, may also be used.

The term "substantially all of monofilament fill yams on the back of the woven carpet backing" means that at the interlaces at least fifty percent (50%) of monofilament fill yams are placed on the back of the woven carpet backing. As described with regard to the multifilament fill yams, the upper limit of the percentage of monofilament fill yams at the interlaces on the back of the woven carpet backing is only limited by the limitations of machines used to weave the woven carpet backing.

Figure 4A:
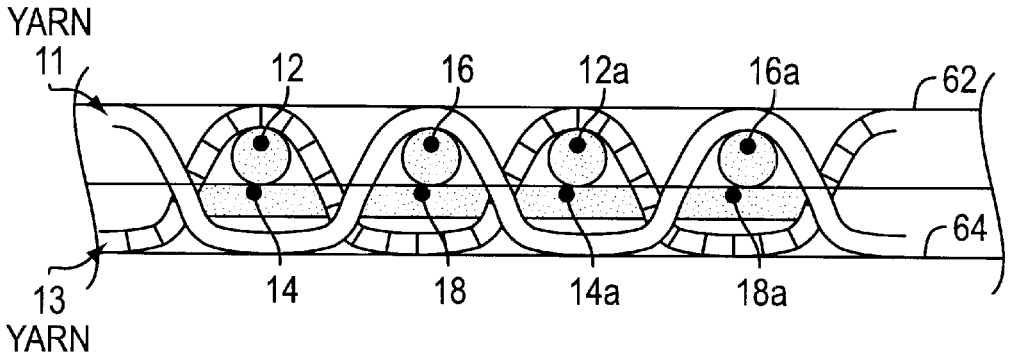
FIGS. 4*a*, and 4*b* are illustrations of cross-sections of a woven carpet backing of FIG. 1 along the lines a and b, respectively.
Figure 4B:
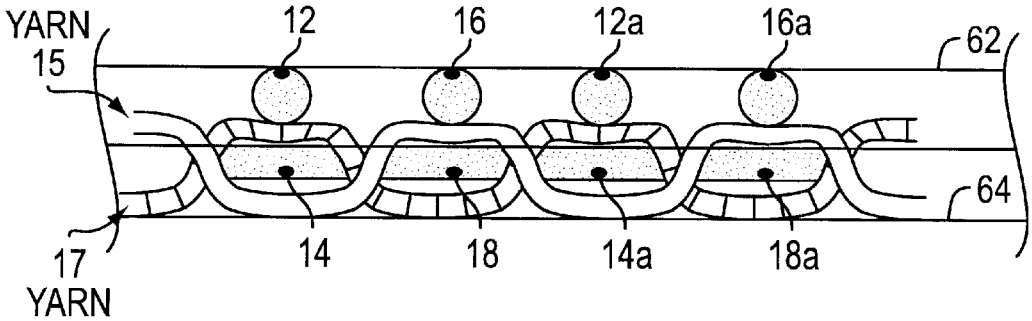

FIGS. 4*a*, and 4*b* provide another illustration of the weave of the embodiment illustrated in FIG. 1, and more particularly, how such a weave results in substantially all of the monofilament fill yams on one side of the woven carpet backing, and substantially all of the multifilament fill yams on the other side of the woven carpet backing. Elements and reference numbers in FIGS. 4*a* and 4*b* correspond to like elements and reference numbers in FIG. 1. According to this embodiment of the invention, a woven carpet backing comprises warp yarns including monofilament yarns (11, 13, 15, 17), such as tape yarns, and fill yarns including alternating monofilament yarns (14, 18, 14*a*, 18*a*), such as tape yarns, and multifilament yarns (12, 16, 12*a*, 16*a*), such as open end spun yarns.

FIGS. 4*a* and 4*b* illustrate cross-sections of a woven carpet backing according to an embodiment of the invention, where the fill yarns have been overstuffed. By overstuffing the fill yarns, multifilament fill yarns (12, 16, 12*a*, 16*a*) are located above their adjacent monofilament fill yarns (14, 18, 14*a*, 18*a*). According to this embodiment of the invention, at least a portion of each multifilament fill yarn (12, 16, 12*a*, 16*a*) is in direct contact with at least a portion of each monofilament fill yarn (14, 18, 14*a*, 18*a*), as shown in FIG. 4*a*. Also, at least a portion of each multifilament fill yarn (12, 16, 12*a*, 16*a*) is located in close proximity to at least a portion of each monofilament fill yarn (14, 18, 14*a*, 18*a*), as shown in FIG. 4*b*. According to this embodiment of the invention, close proximity may result from the monofilament warp yarns (15, 17) being interposed between a portion of each of the multifilament fill yarn and their adjacent monofilament fill yarns. Thus, according to this embodiment of the invention, close proximity may mean that the multifilament fill yarn is separated from its adjacent monofilament fill yarn by substantially the thickness of one monofilament warp yarn (as shown, for example, in FIG. 4*b*).

Thus, as FIGS. 4*a* and 4*b* illustrate, the non-traditional weave of FIG. 1 places substantially all of the multifilament fill yarns on one side of the woven carpet backing, i.e., the face of the woven carpet backing, while the other side of the woven carpet backing, i.e., the back of the woven carpet backing, comprises substantially all monofilament fill yarns. As noted above, the face of the woven carpet backing illustrated in FIGS. 1, 4*a*, and 4*b* comprises seventy-five percent (75%) multifilament fill yarns at the interlaces. This may be best seen by noting that seventy-five percent (75%) of the time, the multifilament fill yarn is located above the monofilament warp yarn at an interlace.

Overstuffing of the fill yarn is an important aspect of the invention. Overstuffing creates a face of the woven carpet backing with substantially all multifilament fill yarns, and a back of the woven carpet backing with substantially all the monofilament fill yarns. Thus, the woven carpet backing has a face with substantially all multifilament fill yarns accessible, and a back with substantially all monofilament fill yarns accessible. Overstuffing relates to the amount of yarns per inch used in a weave and the coverage factor (or "cover factor") of the woven carpet backing. The coverage factor is the fraction of the surface area that is covered by the yarns. For example, the width of a monofilament fill yarn may be about 0.1 inches, and a monofilament fill yarn coverage factor of one hundred percent (100%) may be achieved by using monofilament fill yarns at 10 picks per inch (10×0.10 inches=1 inch). Overstuffing places more yarns in the fill to create a coverage factor of greater than 100%, thereby causing the fill yarns to overlap, as illustrated in FIGS. 4*a* and 4*b*.

The woven carpet backing may have an imaginary face plane (62) and an imaginary back plane (64) (FIGS. 4*a*–4*b*) to define the face and back of the woven carpet backing, respectively. Multifilament fill yarns (12, 12*a*) are biased toward the face plane (62) by three of the warp yarns (11, 15, 17) and biased toward the back plane (64) by one of the warp yarns (13). Multifilament fill yarns (16, 16*a*) are biased toward the face plane (62) by three of the warp yarns (13, 15, 17) and biased toward the back plane (64) by one of the warp yarns (11).

Monofilament fill yarns (14, 14*a*) are biased toward the face plane (62) by two warp yarns (11, 15) and biased toward the back plane (64) by two warp yarns (13, 17), while monofilament fill yarns (18, 18*a*) are biased toward the face plane (62) by two warp yarns (13, 17) and biased toward the back plane (64) by two warp yarns (11, 15). The face plane (62) of the woven carpet backing is thus substantially defined by the multifilament fill yarns.

By way of example only, a woven carpet backing having at the interlaces about eighty percent (80%) of multifilament fill yarns on the face of the woven carpet backing, may have four warp yarns biasing the multifilament fill yarn toward the face of the woven carpet backing and one warp yarn biasing the multifilament fill yarn toward the back of the woven carpet backing.

The back plane (64) of the woven carpet backing is comprised substantially of the monofilament fill yarns. For example, as illustrated in FIGS. 4*a* and 4*b*, monofilament fill yarns (18, 18*a*) are biased (indirectly through multifilament fill yarns (16, 16*a*)) toward the back plane (64) by monofilament warp yarn (11), and monofilament fill yarns (14, 14*a*) are biased (indirectly through multifilament fill yarns (12, 12*a*)) toward the back plane (64) by monofilament warp yarns (13). Further, the monofilament warp yarns (15 and 17) bias monofilament fill yarns (18, 18*a*, 14 and 14*a*) respectively toward the back plane (64).

In any embodiment of the invention, monofilament fill yarns have a width of about 0.08 inches to about 0.12 inches, and preferably about 0.09 inches to about 0.10 inches, and more preferably about 0.095 inches, and a thickness of about 0.010 inches to about 0.050 inches, preferably about 0.015 inches to about 0.030 inches, and more preferably about 0.020 inches. Multifilament fill yarns have a diameter of about 0.01 inches to about 0.15 inches, preferably about 0.03 inches to about 0.1 inches. Monofilament warp yarns have a width of about 0.04 inches to about 0.06 inches, and preferably about 0.045 inches to about 0.055 inches, and more preferably about 0.050 inches, and a thickness of about 0.010 inches to about 0.050 inches, preferably about 0.015 inches to about 0.030 inches, and more preferably about 0.020 inches.

According to an embodiment of the invention, the coverage factor for monofilament fill yarns may be about ninety percent (90%) to about two hundred percent (200%), preferably about one hundred percent (100%) to about one hundred seventy percent (170%), and more preferably about one hundred three percent (103%). The total fill yarn coverage factor (for both the monofilament fill yarns and the multifilament fill yarns) may be about ninety percent (90%) to about three hundred percent (300%), preferably about one hundred percent (100%) to about two hundred percent (200%), and more preferably about one hundred fifty (150%). Other ranges of coverage factor may also be used.

Figure 5A:
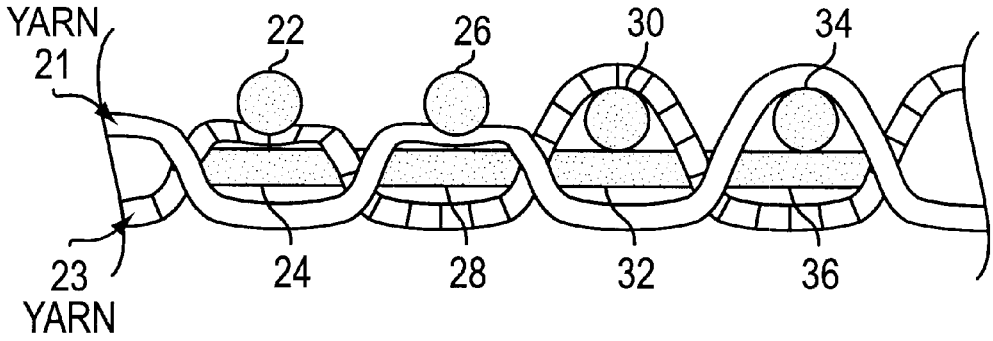
FIGS. 5*a*, and 5*b* are illustrations of cross-sections of a woven carpet backing of FIG. 2 along lines a and b, respectively.
Figure 5B:
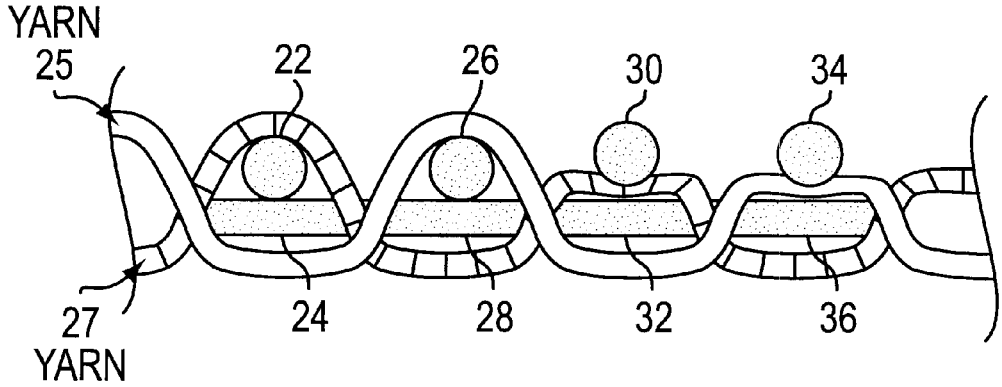

FIGS. 5*a* and 5*b* provide another illustration of the weave of the embodiment illustrated in FIG. 2. Elements and reference numbers in FIGS. 5*a* and 5*b* correspond to like elements and reference numbers in FIG. 2. The woven carpet backing of FIGS. 2, 5*a*, and 5*b* comprises monofilament warp yarns (21, 23, 25, 27), such as tape yarns, and alternating multifilament fill yarns (22, 26, 30, 34), such as open end spun yarns, and monofilament fill yarns (24, 28, 32, 36), such as tape yarns. FIG. 5*a* illustrates a cross-section of the non-traditional weave of FIG. 2 along line a, which allows warp yarns (21, 23) to be viewed simultaneously. FIG. 5*b* illustrates a cross-section of the non-traditional weave of FIG. 2 along the line b, which allows warp yarns (25, 27) to be viewed simultaneously.

Similarly to the embodiment of FIGS. 1, 4*a* and 4*b*, in the embodiment of FIGS. 2, 5*a* and 5*b*, the fill yarns are overstuffed. By overstuffing the fill yarns, multifilament fill yarns (22, 26, 30, 34) are located above their adjacent monofilament fill yarns (24, 28, 32, 36). According to this embodiment of the invention, at least a portion of each multifilament fill yarn (30, 34, 22, 26) is in direct contact with at least a portion of each monofilament fill yarn (32, 36, 24, 28, respectively), as shown in FIGS. 5*a* and 5*b*. Also, at least a portion of each multifilament fill yarn (22, 26, 30, 34) is located in close proximity to at least a portion of each monofilament fill yarn (24, 28, 32, 36, respectively), as shown in FIGS. 5*a* and 5*b*. According to this embodiment of the invention, close proximity may result from the monofilament warp yarns (21, 23, 25, 27) being interposed between a portion of each of the multifilament fill yarn and their adjacent monofilament fill yarns. Thus, according to this embodiment of the invention, close proximity may mean that the multifilament fill yarn is separated from its adjacent monofilament fill yarn by substantially the thickness of monofilament warp yarns (as shown, for example, in FIGS. 5*a* and 5*b*).

Thus, as FIGS. 5*a* and 5*b* illustrate, the non-traditional weave of FIG. 2 places substantially all of the multifilament fill yarns on one side of the woven carpet backing, i.e., the face of the woven carpet backing, while the other side of the woven carpet backing, i.e., the back of the woven carpet backing, comprises substantially all monofilament fill yarns. As noted above, the face of the woven carpet backing illustrated in FIGS. 2, 5*a*, and 5*b* comprises seventy-five percent (75%) multifilament fill yarns at the interlaces. This may be best seen by noting that seventy-five percent (75%) of the time, the multifilament fill yarn is located above the monofilament warp yarn at an interlace.

Placing substantially all of the multifilament fill yarns on one side of the woven carpet backing creates an accessible surface that is primarily multifilament in nature. Conversely, placing substantially all of the monofilament fill yarns on the other side of the woven carpet backing creates an accessible surface that is primarily monofilament in nature. Various factors, as described previously above, may contribute to this characteristic of the woven carpet backing. One such factor may include the close proximity between monofilament fill yarns and multifilament fill yarns. The bias exerted by the monofilament warp yarns on the multifilament fill yarns may also be a factor, thereby causing the multifilament fill yarns to be placed on the face of the woven carpet backing. Overstuffing fill yams causes neighboring (or adjacent) fill yarns to overlap. Additionally, the alternating of monofilament yarns and multifilament yarns in the fill may be a factor. Other factors may also contribute to the aforementioned characteristics of the woven carpet backing.

The woven carpet backing of the invention may be characterized by certain properties.

Measurement of some of such properties is defined in the art, as discussed below. The terms "grabbed" and "pulled" as used herein in connection with the description of the properties of the woven carpet backing of the invention are defined in ASTM Test Method D4632, (1991), discussed more fully below. The properties discussed below were determined in accordance with ASTM Test Method D4632. The woven carpet backing may break when it is grabbed and pulled along the warp yarns at a load of about 50 pounds to about 200 pounds and preferably about 100 to about 150 pounds. A five percent elongation when the woven carpet backing is grabbed and pulled along the warp yarns may occur at a load of about 10 pounds to about 25 pounds. The woven carpet backing may break when it is grabbed and pulled along the fill yarns at a load of about 50 pounds to about 200 pounds and preferably about 75 to about 125 pounds. A five percent elongation when the woven carpet backing is grabbed and pulled along the fill yarns may occur at a load of about 15 pounds to about 40 pounds, and preferably about 20 pounds to about 30 pounds.

Figure 6:
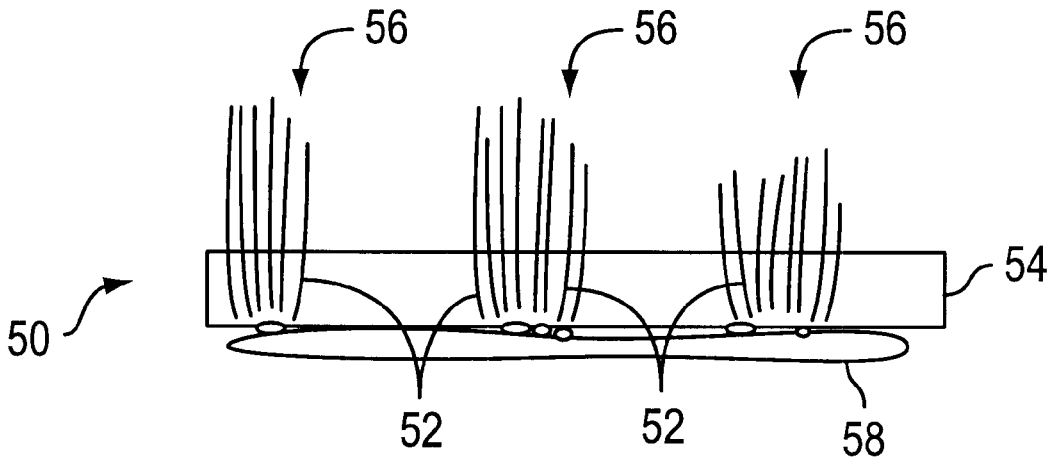
FIG. 6 is a schematic illustration of a carpet made with a backing according to an embodiment of the present invention.

FIG. 6 illustrates a carpet using the present invention. A carpet component (50) may be generally constructed by inserting a piling yarn (52) through a primary backing (54) of the present invention to form tufts of yarn (56) which project from the surface of the primary backing (54). The primary backing (54) is then coated with an adhesive agent (58) to secure the yarn (52) to the primary backing (54). The adhesive agent may be any of the adhesive agents discussed above, such as any conventional adhesive used in the art, e.g., a latex mixture. The finished carpet may then be placed on a specified area of the floor.

Any weave which produces a woven fabric with the characteristics described herein may be used. Persons of ordinary skill in the art will readily understand how to produce the woven carpet backing of the invention from the above description, using conventionally available equipment, such as a loom which is capable of using two different types of fill yarns which are alternating.

Other embodiments and uses of the invention will be apparent to those skilled in the art from consideration of the specification and practice of the invention disclosed herein. The specification and examples should be considered exemplary only. The scope of the invention is defined by the claims appended hereto, and their equivalents.

What is claimed is:

1. A woven backing for carpets including a face and a back and further comprising warp and fill yarns, wherein the warp yarns comprise monofilament yarns and the fill yarns comprise alternating monofilament and multifilament yarns, and wherein the woven backing is woven such that substantially all of the multifilament fill yarns are located on one side of the woven backing, and substantially all of the monofilament fill yarns are located on the other side of the woven backing.

2. The backing of claim 1, wherein the woven backing is woven such that substantially all of the multifilament fill yarns are located on the face of the woven backing and substantially all of the monofilament fill yarns are located on the back of the woven backing.

3. The backing of claim 2, wherein the woven backing is woven such that at the interlaces about seventy-five percent of multifilament fill yarns are placed on the face of the woven backing.

4. The backing of claim 3, wherein the woven backing further comprises a construction of warp yarns of about 24 ends per inch and fill yarns of about 22 picks per inch.

5. The backing of claim 4, which comprises a monofilament fill yarn coverage factor of about 103 percent.

6. The backing of claim 5, which includes a total fill yarn coverage factor of about 150 percent.

7. The backing of claim 1, wherein the woven backing is woven such that the interlaces located on the face of the woven backing are about 75 percent multifilament fill yarns.

8. The backing of claim 1, wherein the woven backing is woven such that the interlaces located on the face of the woven backing comprise about 50 percent to about 83 percent of the multifilament fill yarns.

9. The backing of claim 1, wherein the woven backing further comprises a construction of warp yarns of about 10 to about 40 ends per inch and fill yarns of about 10 to about 50 picks per inch.

10. The backing of claim 1, wherein the woven backing further comprises a construction of warp yarns of about 20 to about 30 ends per inch and fill yarns of about 20 to about 40 picks per inch.

11. The backing of claim 1, wherein the woven backing further comprises a construction of warp yarns of about 22 to about 26 ends per inch and fill yarns of about 21 to about 30 picks per inch.

12. The backing of claim 1, wherein the woven backing further comprises a construction of warp yarns of about 24 ends per inch and fill yarns of about 22 picks per inch.

13. The backing of claim 1, which comprises a monofilament fill yarn coverage factor of about 90 percent to about 200 percent.

14. The backing of claim 1, which comprises monofilament fill yarn coverage factor of about 100 percent to about 170 percent.

15. The backing of claim 1, which comprises a monofilament fill yarn coverage factor of about 103 percent.

16. The backing of claim 1, which comprises a total fill yarn coverage factor of about 90 percent to about 300 percent.

17. The backing of claim 1, which comprises a total fill yarn coverage factor of about 100 percent to about 200 percent.

18. The backing of claim 1, which comprises a total fill yarn coverage factor of about 150 percent.

19. The backing of claim 1, wherein the woven carpet backing is woven such that a portion of each multifilament fill yarn is located above and in physical contact with a portion of at least one monofilament fill yarn.

20. The backing of claim 1, wherein the woven carpet backing is woven such that a portion of each multifilament fill yarn is located above and in close proximity to a portion of at least one monofilament fill yarn.

21. The backing of claim 20 wherein close proximity comprises about the thickness of a monofilament warp yarn.

22. A woven backing for carpets including a face and a back comprising:

a warp and a fill including two yarn types, wherein one of the warp and the fill includes the two yarn types in an alternating fashion and the other of the warp and the fill includes one of the two yarn types; and wherein the warp yarns and the fill yarns are woven such that substantially all of one of the two alternating yarn types is placed on one side of the woven backing and substantially all of the other of the two alternating yarn types is placed on the other side of the woven backing.

23. The backing of claim 22, wherein the two yarn types comprise monofilament yarns and multifilament yarns.

24. The backing of claim 23, wherein the woven backing is woven such that substantially all of the multifilament yarns of the two alternating yarn types are located on the face of the woven backing and substantially all of the monofilament yarns of the two alternating yarn types are located on the back of the woven backing.

25. The backing of claim 22, wherein at least one of the warp yarns and fill yarns comprises multifilament yarns.

26. The backing of claim 22 wherein the woven backing further comprises a construction of warp yarns of about 10 to about 40 ends per inch and fill yarns of about 10 to about 50 picks per inch.

27. The backing of claim 22, wherein the woven backing further comprises a construction of warp yarns of about 20 to about 30 ends per inch and fill yarns of about 20 to about 40 picks per inch.

28. The backing of claim 22, wherein the woven backing further comprises a construction of warp yarns of about 22 to about 26 ends per inch and fill yams of about 21 to about 30 picks per inch.

29. The backing of claim 22, wherein the woven backing further comprises a construction of warp yarns of about 24 ends per inch and fill yarns of about 22 picks per inch.

30. The backing of claim 22, wherein the one of the two yarn types is located in the warp, and the two alternating yarns types are located in the fill.

31. The backing of claim 30, wherein one of the two alternating yarns is woven to comprise a fill yarn coverage factor of about 90 percent to about 200 percent.

32. The backing of claim 30, wherein one of the two alternating yarns is woven to comprise a fill yarn coverage factor of about 100 percent to about 170 percent.

33. The backing of claim 30, wherein one of the two alternating yarns is woven to comprise a fill yarn coverage factor of about 103 percent.

34. The backing of claim 30, which comprises a total fill yarn coverage factor of about 90 percent to about 300 percent.

35. The backing of claim 30, which comprises a total fill yarn coverage factor of about 100 percent to about 200 percent.

36. The backing of claim 30, which comprises a total fill yarn coverage factor of about 150 percent.

* * * * *